US005143235A

United States Patent [19]

Repp

[11] Patent Number: 5,143,235

[45] Date of Patent: Sep. 1, 1992

[54] BOTTLE NECK HAVING MEANS TO PREVENT COMPRESSION OF CAP SKIRT

[75] Inventor: Richard E. Repp, San Jose, Calif.

[73] Assignee: Cap Snap Co., San Jose, Calif.

[21] Appl. No.: 567,591

[22] Filed: Aug. 15, 1990

[51] Int. Cl.[5] ..... B65D 1/02; B65D 41/48

[52] U.S. Cl. ..... 215/256; 215/31; 215/320; 215/321

[58] Field of Search ..... 220/306, 675, 270; 215/31, 317, 320, 365, 256, 321

[56] References Cited

U.S. PATENT DOCUMENTS

| | | | |
|---|---|---|---|
| 3,618,802 | 11/1971 | Yates, Jr. | 215/321 |
| 3,837,519 | 9/1974 | Perry | 215/365 |
| 4,098,421 | 7/1978 | Foster | 220/306 X |
| 4,166,552 | 9/1979 | Faulstich | 215/321 X |
| 4,496,066 | 1/1985 | Bullock, III | 215/320 |
| 4,512,493 | 4/1985 | Von Holdt | 220/306 |
| 4,546,892 | 10/1985 | Couput | 215/317 X |
| 4,566,601 | 1/1986 | Kuenzig | 220/675 X |
| 4,660,735 | 4/1987 | Peschardi et al. | 215/256 X |
| 4,676,389 | 6/1987 | Bullock | 215/31 X |
| 4,687,114 | 8/1987 | Crisci | 215/256 |
| 4,700,860 | 10/1987 | Li | 215/317 X |
| 4,732,289 | 3/1988 | Granat et al. | 215/31 X |
| 4,744,480 | 5/1988 | Luch et al. | 215/31 X |
| 4,815,617 | 3/1989 | Cullum | 215/256 X |
| 4,884,706 | 12/1989 | Julian | 215/31 X |
| 4,895,265 | 1/1990 | Luch et al. | 215/31 |

FOREIGN PATENT DOCUMENTS

| | | | |
|---|---|---|---|
| 2256081 | 7/1975 | France | 215/31 |
| 1483403 | 8/1977 | United Kingdom | 215/31 |

*Primary Examiner*—Sue A. Weaver
*Attorney, Agent, or Firm*—Julian Caplan

[57] ABSTRACT

Container neck finishes produced by preforming processes such as injection or compression molding can generally be made to more accurate dimensions than blow molded finishes. Blow molded bottles conventionally have had an outward slanted area below the locking beads which merges into a horizontal shoulder on which the lower edge of the cap skirt rests, the slanted areas preventing the lower portion of the skirt from being compressed or pinched-in. As a substitute for the slanted area of blow molded bottles, the present invention provides annular rings on a preformed finish which supports the skirt against compression and a larger diameter second annular ring which functions as a shoulder on which the lower edge of the cap skirt may rest.

15 Claims, 2 Drawing Sheets

BOTTLE NECK HAVING MEANS TO PREVENT COMPRESSION OF CAP SKIRT

BACKGROUND OF THE INVENTION

1. Field of the Invention

This invention relates to a new and improved neck finish (i.e., shape) for a bottle characterized, among other features, by the provision of one or more annular rings on the exterior of the neck which engage the inside of the lower portion of the cap skirt to prevent inward compression or pinching of the cap skirt and by modification of the external locking beads and by the shape of the neck interior.

2. Description of Related Art

Containers having performed or injected finishes have become increasingly popular because of material characteristics and the greater precision of the dimensions which can be achieved as contrasted with blow-molded neck finishes. Neck finishes of the blow-molded type used with snap-on type caps conventionally have been formed with outward-downward slanted areas adjacent the inside of the lower portion of the cap skirt to prevent inward deformation of the cap. If such deformation were to occur, it would interfere with the tamper evident features of conventional snap-on type caps.

To make the neck exterior of performed finishes in the aforesaid downward sloping area of solid material extending outward from an otherwise straight neck would require a considerable additional weight of plastic as compared with use of the present invention. The present invention eliminates the solid exterior in the aforesaid area and replaces the same with one or more annular rings on the exterior of an otherwise straight neck exterior.

Below the aforementioned ring, bottles have a transfer ring conventionally gripped in equipment for filling and handling the containers. This transfer ring is also sometimes called a bumper ring. In accordance with the present invention, the transfer ring is located below the anti-compression ring and may form a shoulder against which the lower edge of the cap skirt seats.

SUMMARY OF THE INVENTION

A bottle molded of PET or other suitable plastic has a performed neck having a inner wall and generally vertical exterior wall from which the various beads and rings hereinafter described protrude. Upper and lower locking beads which cooperate with corresponding upper and lower locking beads on the interior of the cap skirt to hold the cap in place may be generally similar in shape, location and function to the corresponding beads used on blow molded bottles. A ring of enlarged external diameter is formed on the exterior of the neck and the bottom edge of the push-on cap skirt seats against or in close proximity to the upper horizontal surface of the enlarged ring. This enlarged ring may also serve as a transfer ring used in loading and filling the bottle. To prevent the ca skirt from being pinched or compressed inward in the area between the lowermost locking bead and the enlarged ring, one or more external annular anti-compression rings are provided which bear against the inside of the cap skirt. Optionally, gusset-like guide-on fins are formed at intervals around the circumference of the aforesaid mentioned rings. These fins function to guide the lower edge of the cap skirt outside the anticompression rings while the cap is being applied to the neck. Similar fins may optionally be formed on the upper surface of the enlarged lower ring to guide the cap into place.

The cap of the present invention used with the above described neck is of the tamper evident, push-on type having internal locking beads which inter-engage with the external beads of the neck after the cap has been pushed onto the neck. When the cap skirt is intact, it cannot be removed without destroying the tamper evident features of the cap. In order to remove the cap, conventional means are used including a tear tab which the consumer pulls upward to tear the lower portion of the cap along a generally vertical or upward slanted or curved score line to merge with a horizontal score line between the internal beads of the cap. When the lower bead is torn off along with the lower portion of the cap, the portion of the cap thereabove constitutes a reclosure cap which may be removed or replaced as required until the contents of the container are exhausted.

In order to enable a conventional, commercially available snap-on type cap to be used with the aforesaid neck finish, some additional neck finish modifications are desirable. The upper surfaces of the external neck locking beads and the anti-compression ring(s) are sloped outward-downward so that the lower edge of the cap skirt slides over them instead of lodging thereon.

Further, in order to facilitate entry of the hollow plug or inner skirt of the cap into the neck, the upper edge of the neck slants upward-outward in a lead-in portion so that the cap plug initially encounters a sloping surface which guides it into the neck. It is desirable that performed finishes have approximately uniform wall thickness. To achieve this objective, the upper internal surface below the lead-in portion may be formed with a cut out or increased diameter portion.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
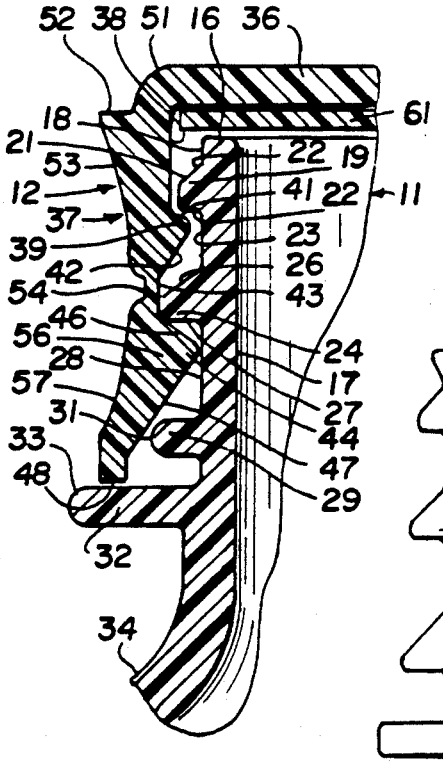
FIG. 1 is a fragmentary vertical sectional view through a cap and neck in accordance with the present invention.

The present invention relates to a performed or injected neck 11 which receives a snap-on type cap 12 partially shown in FIG. 1. PET (polyethylene phthalate) is one suitable material. Neck 11 generally includes inside 17 and outside walls, the upper ends of which join a horizontal lip 16.

Proceeding downwardly from lip 16 on the exterior of the neck 11 there is a short vertical first external cylindrical surface 18 below which is first locking bead 19. Bead 19 is formed by an outward downward slanted upper surface 21 which merges with a lower horizontal shoulder 22. The slanted surface 21 guides the upper internal bead of the cap (hereinafter described) as the cap is forced downwardly relative to the neck so that the cap bead expands outwardly and clears the external bead of the neck.

Below bead 19 is second cylindrical external surface 23 below which is second locking bead 24. Bead 24 has an outward downward slanted top surface 26 which merges with a lower horizontal shoulder 27. Bead 24 may have a greater diameter than bead 19.

Below the bead 24 is third external cylindrical portion 28 on the lower end of which is first anti-compression external annular ring 29. Ring 29 has a rounded outer edge 31. As has been mentioned previously and is hereinafter described in detail, the greatest diameter of ring 29 is dimensioned similar to the inside diameter of the cap skirt and prevents the same from being pinched or compressed inwardly. Depending upon the internal dimensions of the cap skirt, ring 29 may be of greater diameter than bead 24. If the skirt were not held against such compression it might be possible for a dishonest consumer to remove the cap 12 without disturbing its tamper evident features.

Below ring 29 is a short third external cylindrical portion 30. Below cylinder 30 is ring 32 of greater outside diameter than the ring 29. Ring 32 may also serve as a transfer or bumper ring, preferably having a rounded outer edge 33. The end of the neck 11 below ring 32 generally is outwardly in a conical shape 34, the structure below ring 32 being incidental to the invention of the present application.

Various caps 12 of the push on or snap on type may be used with the neck 11. Such caps are usually of a stretchable material such as low density polyethylene.

The particular cap shown in FIG. 1 is subject to wide variation depending upon the requirements of the user. As shown, the cap has no inner skirt or plug which fits inside the neck surface 17 but it will be understood that such plugs or inner skirts may be used.

Directing attention now to the details of FIG. 1, the cap has a top disk 36. Around the periphery of the disk 36 is a generally vertical skirt 37, the lower edge 48 of which rests in close proximity to the top surface of ring 32.

Directing attention to the interior of skirt 37, at the upper end thereof, immediately below disk 36 is first internal cylindrical surface 38, on the lower end of which is first or upper locking bead 39. Bead 39 has a substantially horizontal shoulder 41 which in the assembled position of the cap and neck engages under the shoulder 22. Below the shoulder 41 is a downward outward slanted surface 42 which cooperates with the slanted surface 21 of the neck to insure that the bead 29 stretches and then snaps under the bead 19.

Below bead 19 is a second cylindrical portion 43 below which is second or lower locking bead 44. Bead 44 has a downward inward slanted top surface 46 but the surface 46 functions similarly to a horizontal shoulder to engage under shoulder 27. Below bead 44 the interior of the cap 12 slants downwardly outwardly in a surface 47 which extends almost to the bottom edge 48. As is seen, the rounded edge 31 of ring 29 is located close to surface 47 and prevents the same from being pinched or compressed inward.

Directing attention now to the exterior of cap 12, there is a rounded corner 51 around the periphery of the disk 36 and below the corner 51 is a flange 52 useful in stacking caps one upon the other. The cap slants downward inward below shoulder 52 in a surface 53 which is interrupted by an external horizontal scored tear line 54. Lower skirt portion 56 has an outward-downward slanted surface 57 extending substantially to the lower edge 48. Although not shown in the accompanying drawings, it will be understood that there are a tear tab and a vertical or slanted or curved score line adjacent the tear tab which merges with the score line 54. By pulling upward on the tear tab and the generally vertical score line and thence around the score line 54, lower skirt 56 may be torn away and thereupon the upper portion or reclosure portion of the cap may be easily removed and reapplied. Other means for tearing away lower skirt 56 and bead 44 may be used.

To seal the cap 12 to the neck 11 a seal disk 61 of fiber or plastic or other suitable material may be used,. it being understood that the seal disk 61 seals against the lip 16 to prevent escape of liquid from the container.

It will be understood that the beads 29 and 44 may be solid or one or both thereof may be interrupted as per U.S. Pat. No. 4,676,389.

Figure 2:
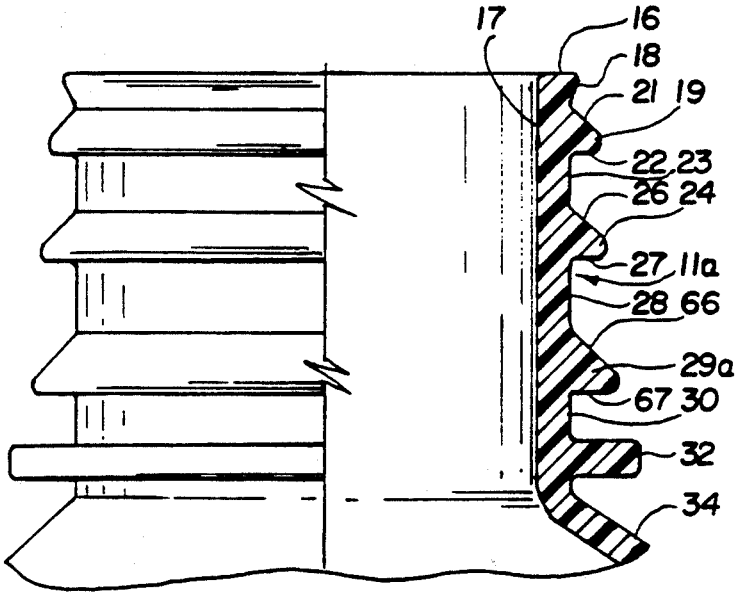
FIG. 2 is a fragmentary elevational view of a modified neck, the right hand half of the neck being cut away.
Figure 6:
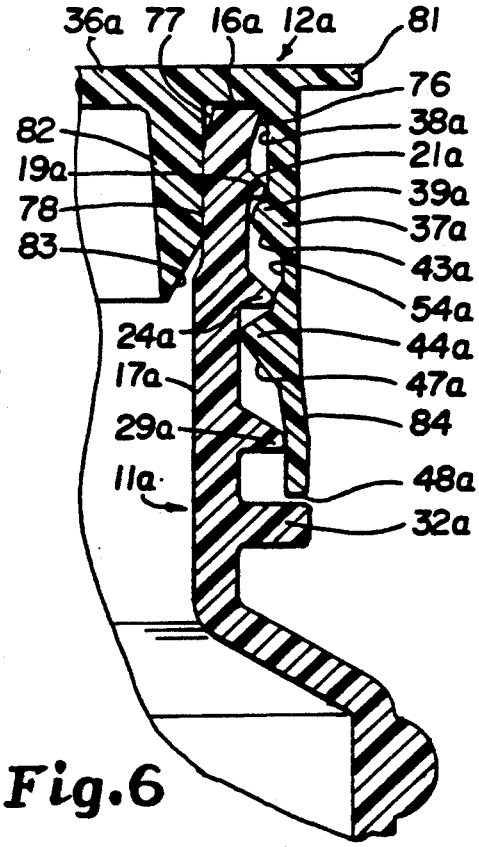
FIG. 6 is an enlarged fragmentary sectional view through a portion of a neck and a cap seated thereon.

Directing attention now to FIG. 2 and the modified cap and cap neck shown in FIG. 6, the lip **16*a* is displaced outwardly so that there is an external downward-inward slanted surface 76 above surface 18*a* and an internal downward-inward slanted surface 77. Slanted surface 77 assists in guiding the hollow plug on inner skirt 82 of the cap into the bottle neck. It is desirable that the wall thickness of the neck be as close to uniform as practical. For this reason, an internal cylindrical cut-out 78 is formed in neck 11*a***.

The cap **12*a* preferably used with the neck 11*a* of FIG. 2 is a conventional snap-on, tamper-evident cap such as shown in U.S. Pat. No. 4,496,066. Such a cap may have a liner such as seal disk 61 shown in FIG. 1. Alternatively, the cap has a hollow plug or inner skirt 82 shown in FIG. 6. The skirt 82 is formed of downward-inward slanted outer edge 83 which also assists in guiding the plug or inner skirt 82** into place.

The downward-outward slanted top surfaces on locking beads **19*a* and 27*a* and on ring 29*a* in cooperation with the downward-outward slanted surfaces 43*a* and 47*a* cause the cap 12*a* to slide down neck 11*a* until beads 19*a*–39*a*, 24*a*–44*a* lock in place. The lower edge 48*a* of skirt 37*a* bulges outward over ring 29*a*, as best shown at reference numeral 84 in FIG. 6. It will be understood that beads 39*a* and 44*a* may be continuous or interrupted. The upper surface 66 of annular ring 29*a* of neck 11*a* is downwardly outwardly slanted, while the lower surface 67 thereof is preferably horizontal. The slanted surface 66, when engaged by lower edge 48 guides the cap into position and also stretches the lower edge 48 so that it slides over ring 29*a***.

Figure 3:
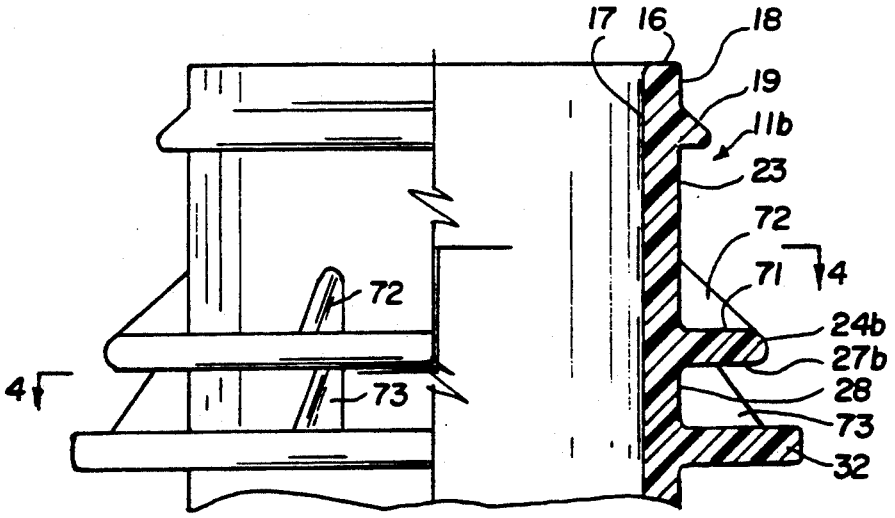
FIG. 3 is a view similar to FIG. 2 of a further modification.
Figure 4:
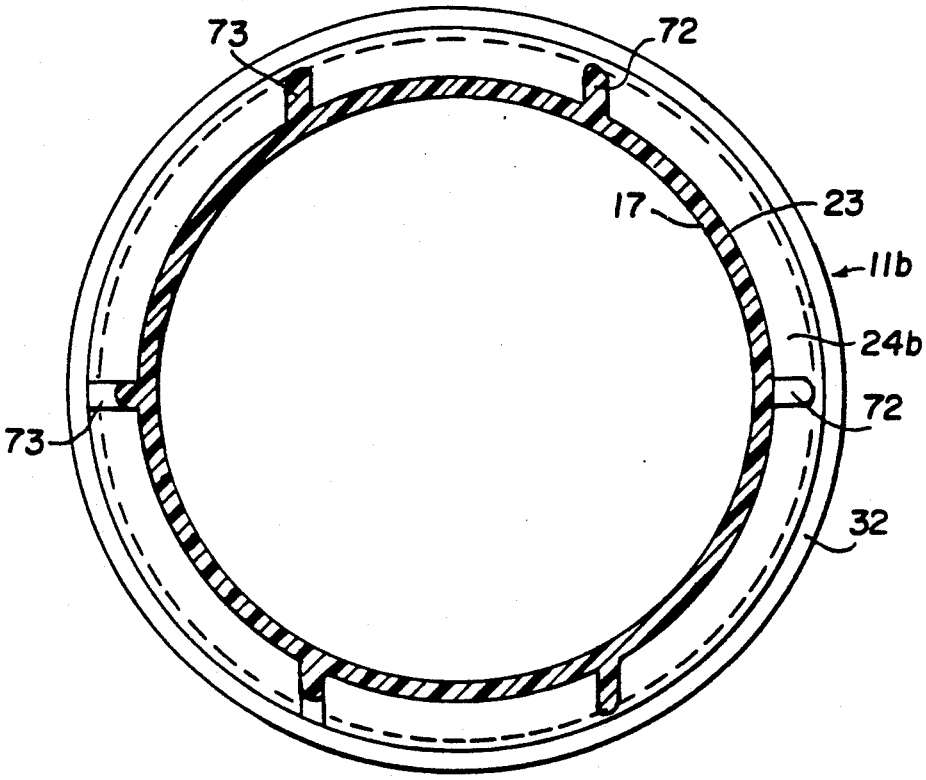
FIG. 4 is a sectional view taken substantially along the line 4—4 of FIG. 3.

Directing attention now to FIG. 3, whereas in FIG. 2 the slanted surface 66 was continuous around the circumference of ring 29*a*, the neck 11*b* of FIGS. 3 and 4 has angularly spaced substantially vertical guide-on fins 72 which perform the same function as the surface 66 of FIG. 2. Using fins 72 of limited width reduces the quantity of plastic required to form the neck 11*b*. As also shown in FIG. 3, similar gussets or guide-on fins 73 may be formed above the top surface of bumper ring 32. However, since the lower edge 48 of cap 12 must seat on the top of ring 32, the outward extent of the gusset 73 is spaced inward from the outer edge of ring 32. The top surface 71 and bottom surface 27*b* of locking beat 24*b* are preferably horizontal.

Another feature of the structure shown in FIG. 3 is that the annular ring 24*b* functions as the second external locking bead of the neck 11*b*. Such an arrangement is feasible when the locking bead 44 is in close proximity to the lower edge 48 of the cap.

Figure 5:
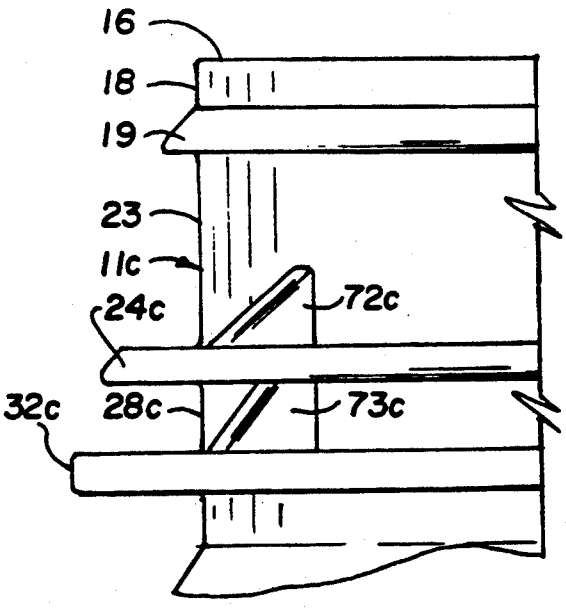
FIG. 5 is an elevational view of one-half of a neck modified from the construction of FIGS. 3 and 4.

Directing attention to FIG. 5, the guide-on fins 72*c* and 73*c* on the exterior of neck 11*c*, instead of being shown as parallel as their corresponding elements in FIG. 4, are slanted or skewed as shown at 72*c* and 73*c*. FIG. 6 shows a modified cap 12*a* applied to neck 11*a*. Cap 12*a* has a bendable outward extending peripheral flange 81 at its top.

In many respects the neck structures of FIGS. 2, 3 and 5 resemble those of FIG. 1 and the same reference numerals followed by the subscripts a, b and c, respectively, are used to designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A container neck for use with a snap-on type cap having a top disk and a depending peripheral skirt, said skirt having snap-on locking means on its interior, tamper-evident means on its lower portion including at least a part of said locking means and removal means for said tamper evident means for removing that portion of said skirt containing said tamper-evident means, said skirt having a substantially horizontal lower edge at the bottom of said tamper-evident means, said neck having an upper lip and the exterior of said neck below said lip comprising circumferential, horizontal, snap-on bead means engageable with said locking means, whereby when said cap is seated on said neck said cap is held on said neck until said removal means is employed by the user to remove said tamper-evident means, and at least one thin ring extending outwardly of said neck which, when said cap is seated on said neck, is located above said lower edge of said skirt and positioned to fit inside the lower portion of said skirt substantially above said lower edge of said skirt to secure said skirt against inward pinching or compression, said ring having top and bottom surfaces spaced apart a distance substantially less than the distance between said bead means and said lower edge of said skirt and said ring extending outwardly at least as far as said bead means, said bottom surface being substantially horizontal.

2. A neck construction according to claim 1, wherein said locking means comprises upper and lower cap locking beads and said bead means comprises a first neck bead engageable with said upper cap locking bead and a second neck bead engageable with said lower cap locking bead, said tamper-evident means containing said lower locking bead.

3. A neck according to claim 2 in which said second neck bead comprises a downward-outward sloping top surface and a substantially horizontal bottom surface.

4. A neck according to claim 3 in which the maximum diameter of said second neck bead is substantially greater than that of said first neck bead.

5. A neck construction according to claim 1 for use with a cap of the type having a central plug, said upper lip being upwardly outwardly slanted at its upper end.

6. A neck construction according to claim 5 in which the interior of the upper end of said neck has a larger bore than said interior below said plug in the assembled condition of said cap and neck.

7. A neck according to claim 1 which further comprises an enlarged ring below said first-mentioned ring positioned so that the lower edge of said skirt rests on said enlarged ring.

8. A neck according to claim 1 in which said ring comprises a substantially horizontal bottom surface and a downward-outward slanted top surface.

9. A neck according to claim 8 in which the outer edge of said ring is rounded.

10. A neck according to claim 1 in which said neck bead means comprises a downward-outward sloping top surface and a substantially horizontal bottom surface.

11. A container neck for use with a cap of the type having a top disk and a depending peripheral skirt, said skirt having locking means on its interior, tamper-evident means and removal means for removing that portion of said skirt containing said tamper-evident means, said neck having an upper lip and the exterior of said neck below said lip comprising bead means engageable with said locking means, whereby when said cap is seated on said neck said cap is held on said neck until said removal means is employed by the user to remove said tamper-evident means, and at least one ring extending outwardly of said neck which, when said cap is seated on said neck, is located adjacent the lower end of said skirt positioned to fit inside the lower portion of said skirt to secure said skirt against inward pinching or compression, said ring having top and bottom surfaces and a plurality of circumferentially spaced guide-on fins extending upward-inward from the outer edge of the top surface of said ring.

12. A neck according to claim 11 in which said ring and said bead means are the co-extensive.

13. A neck according to claim 11 which further comprises an enlarged ring below said first-mentioned ring positioned so that the lower edge of said skirt rests on said enlarged ring.

14. A neck according to claim 13 which further comprises a plurality of circumferentially spaced second guide-on fins extending upward-inward from said enlarged ring, said second fins terminating spaced inward from the periphery of said enlarged ring.

15. A neck according to claim 14 in which said second fins are skewed relative to a vertical plane through the vertical axis of said neck.

* * * * *